US009216881B2

(12) United States Patent
Banno

(10) Patent No.: US 9,216,881 B2
(45) Date of Patent: Dec. 22, 2015

(54) CAR POWER SUPPLY DEVICE OF ELEVATOR

(75) Inventor: Hirokazu Banno, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 374 days.

(21) Appl. No.: 13/515,431

(22) PCT Filed: Jan. 29, 2010

(86) PCT No.: PCT/JP2010/051282

§ 371 (c)(1),
(2), (4) Date: Jun. 12, 2012

(87) PCT Pub. No.: WO2011/092853

PCT Pub. Date: Aug. 4, 2011

(65) Prior Publication Data

US 2012/0247878 A1 Oct. 4, 2012

(51) Int. Cl.
*B66B 1/34* (2006.01)
*B66B 7/06* (2006.01)

(52) U.S. Cl.
CPC .. *B66B 7/064* (2013.01); *B66B 1/34* (2013.01)

(58) Field of Classification Search
CPC ..... B66B 7/064; B66B 7/06; B66B 1/34
USPC ..... 187/413
See application file for complete search history.

(56) References Cited

U.S. PATENT DOCUMENTS 6,333,865 B1 * 12/2001 Yumura et al. ..... 363/132
2001/0004033 A1 6/2001 Nihei et al.

FOREIGN PATENT DOCUMENTS

| | | |
|---|---|---|
| CN | 101198536 A | 6/2008 |
| CN | 101362569 A | 2/2009 |
| JP | 3 56382 | 3/1991 |
| JP | 11 79574 | 3/1999 |
| JP | 2000 355474 | 12/2000 |
| JP | 2001 163533 | 6/2001 |
| JP | 2002 274763 | 9/2002 |

(Continued)

OTHER PUBLICATIONS

English Machine Translation of JP 11-79574 A.*
International Preliminary Report on Patentability issued Aug. 16, 2012, in PCT/JP2010/051282.
Written Opinion of the International Searching Authority issued Mar. 30, 2010, in PCT/JP2010/051282.

(Continued)

*Primary Examiner* — William E Dondero
*Assistant Examiner* — Diem Tran
(74) *Attorney, Agent, or Firm* — Oblon, McClelland, Maier & Neustadt, L.L.P.

(57) ABSTRACT

A car power supply device of an elevator which performs power supply to a car without using a traveling cable, does not require arrangement of a power supply line along the whole path, has good installability and layout capability, and in which weight balance between a car and a counterweight is taken into consideration. A car power supply device of an elevator which lifts and lowers a car and a counterweight in a well-bucket manner arranged to be able to ascend and descent in a shaft of an elevator includes: a power supply line arranged in the shaft along the path of the car and the counterweight; and power receiving devices provided each in the car and the counterweight and that receive power supply from the power supply line. In this car power supply device of an elevator, the power receiving device of the car and the power receiving device of the counterweight receive power supply from the same power supply line.

8 Claims, 5 Drawing Sheets

(56) References Cited

FOREIGN PATENT DOCUMENTS

| | | | | |
|---|---|---|---|---|
| JP | 2007246266 | A | * | 9/2007 |
| JP | 2008154342 | A | * | 7/2008 |
| JP | 2009-40589 | | | 2/2009 |
| JP | 2009044918 | A | * | 2/2009 |

OTHER PUBLICATIONS

Chinese Office Action issued Nov. 4, 2013, in China Patent Application No. 201080062226.4 (with partial English translation).

International Search Report Issued Mar. 30, 2010 in PCT/JP10/51282 filed Jan. 29, 2010.

* cited by examiner

CAR POWER SUPPLY DEVICE OF ELEVATOR

TECHNICAL FIELD

The present invention relates to a car power supply device of an elevator.

BACKGROUND ART

In conventional elevators, it is a general practice to electrically connect the control device in a machine room and the car by a traveling cable in order to supply the power for opening and closing the door and for lighting, which are required by the car of an elevator, and the power to each device provided in the car and in order to transmit control signals.

However, because this traveling cable becomes long in a skyscraper elevator installed in a building with a large building height, due to the effects of the weight and swing of the traveling cable itself and the like, troubles such as cutting of the traveling cable may occur. Also, voltage drops increase because of the long traveling cable and, therefore, it is necessary to make the core wires of the traveling cable thick or to increase the number of traveling cables to be used.

Therefore, there is an idea that the supply of power (power supply) to the car and a signal transmission are performed without relying on the traveling cable. The signal transmission can be relatively easily realized by radio transmission and optical transmission.

For the power supply to the car, there has hitherto been known a method which involves providing a power accumulation device, such as a battery, in a car, and accumulating power as required in each device of the car via a power conversion device, such as an inverter, from this power accumulation device, providing a power supply device on each service floor of the elevator, and from this power supply device, performing the charging of the power accumulation device as required via a power conversion device, such as a converter, while the elevator is stopped.

For conventional car power supply devices of an elevator, in an elevator in which a car and a counterweight are hung in a shaft in such a manner as to be able to ascend and descend in a well-bucket manner along each guide rail via a main rope wound and suspended on a sheave in the upper part of the shaft and a drive unit for ascent and descent is provided in either or both of the car and the counterweight, there is known another car power supply device in which a power transmission line which permits power transmission between the above-described car and the above-described counterweight is provided so as to pierce through the above-described main rope, a power supply line which supplies power only to either the above-described car or the above-described counterweight is provided, and by using this power supply line and the above-described power transmission line between the main rope, power supply is performed to the above-described drive unit for ascent and descent and the car-side electrical equipment such as lighting (refer to Patent Literature 1, for example).

And as a car power supply device which performs power supply from power supply means to power receiving means in the power supply to a car and a counterweight in a noncontact manner, there is known, for example, a car power supply device in which a power supply device is provided in a position opposed to the position of the counterweight in the case where a car in a shaft is stopped at a standard floor, the counterweight is provided with power receiving means which receives the power from this power supply device in a noncontact manner, an inverter and a motor which drives the counterweight vertically, and on the basis of positions detected by means which detects the positions of the above-described power supply device and the above-described power receiving means, the counterweight is driven so that the above-described power receiving means is opposed to the above-described power supply device (refer to Patent Literature 2, for example).

CITATION LIST

Patent Literature

Patent Literature 2: Japanese Patent Laid-Open No. 11-079574

Patent Literature 1: Japanese Patent Laid-Open No. 2001-163533

SUMMARY OF INVENTION

Technical Problem

However, in the conventional car power supply device of an elevator described in Patent Literature 1, power is fed to only either the car or the counterweight. Therefore, it is necessary to arrange the power supply line in the whole travel of the car or the counterweight and this is complicated and poses the problem of poor installability and layout capability. Because the power receiving means is installed only in either the car or the counterweight, the balance is bad, and for example, in the case where the power receiving means is installed only on the car side, it is necessary to add a weight equivalent to the weight of this power receiving means to a counterweight, posing the problem that an excess weight increases as the whole device.

In the conventional car power supply device of an elevator described in Patent Literature 2, the charging of the power accumulation device (power supply to the car) is possible only when the car is stopped at a prescribed standard floor and inevitably, it is necessary to perform rapid charging. This car power supply device of an elevator has the problem that there is a possibility that in some cases, charging is not completed and it becomes impossible to obtain necessary power.

The present invention was made to solve such problems and the object of the invention is to provide a car power supply device of an elevator which performs power supply to a car using a power supply line provided in a shaft as described in Patent Literature 1 without using a traveling cable, does not require the arrangement of a power supply line along the whole travel, and has good installability and layout capability and in which the weight balance between the car and a counterweight is taken into consideration.

Means for Solving the Problems

A car power supply device of an elevator according to the present invention, which lifts and lowers a car and a counterweight in a well-bucket manner which are arranged in such a manner as to be able to ascend and descend in a shaft of the elevator, comprises: a power supply line which is arranged in the shaft along the path of the car and the counterweight; and power receiving devices which are provided each in the car and the counterweight and receive power supply from the power supply line, wherein the power receiving device of the car and the power receiving device of the counterweight both receive power supply from the same power supply line.

Advantageous Effects of Invention

In the car power supply device of an elevator of the present invention, which performs power supply to a car using a power supply line provided in a shaft without using a traveling cable, the advantages of good installability and layout capability as well as good weight balance between the car and the counterweight are provided.

DESCRIPTION OF EMBODIMENTS

The present invention will be described with reference to the accompanying drawings. In each of the drawings, like characters refer to like or corresponding parts and overlaps of description of these parts are appropriately simplified or omitted.

Embodiment 1

Figure 1:
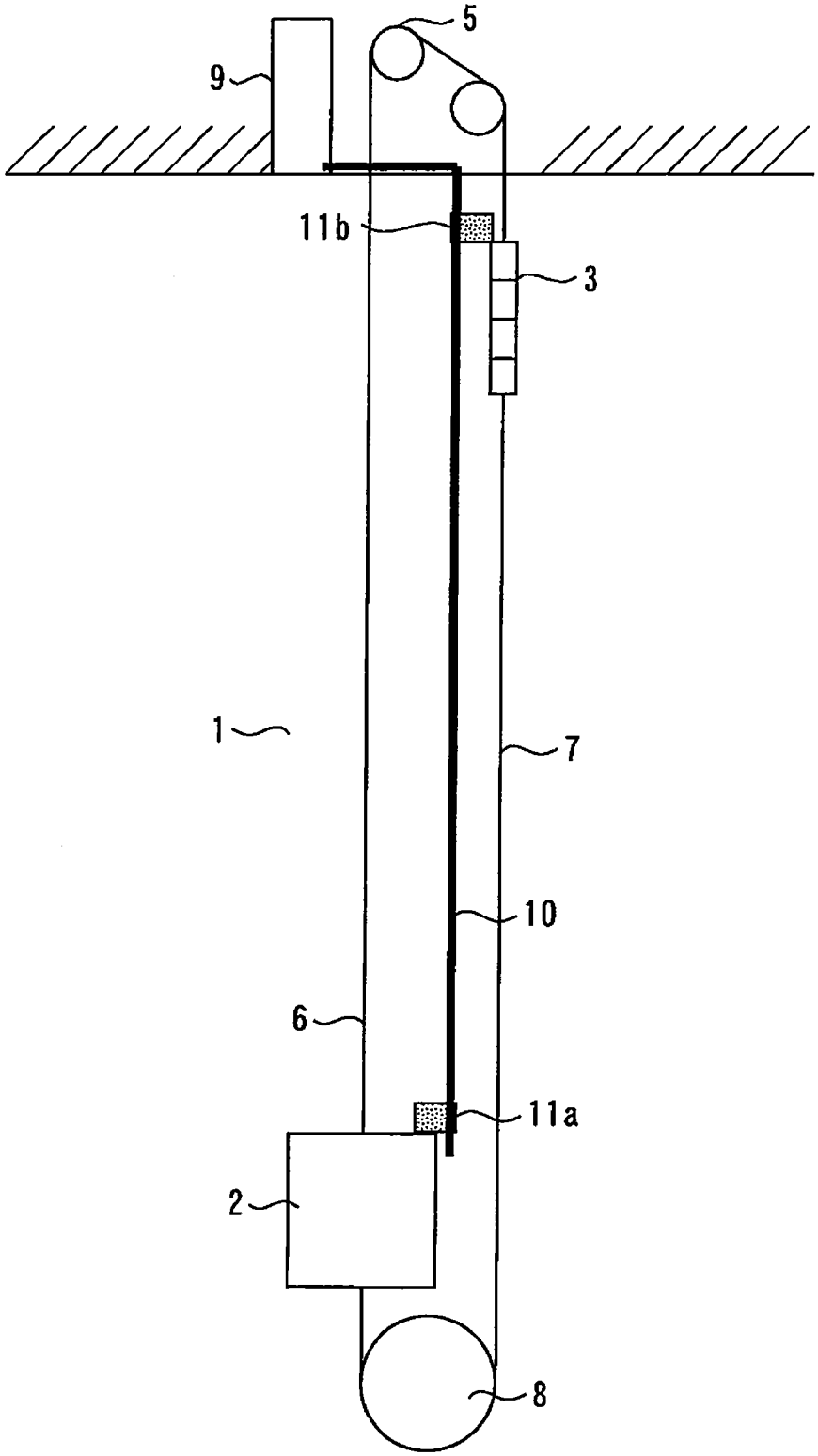
FIG. 1 is a side view showing the general configuration of a car power supply device of an elevator related to first embodiment of the present invention.
Figure 2:
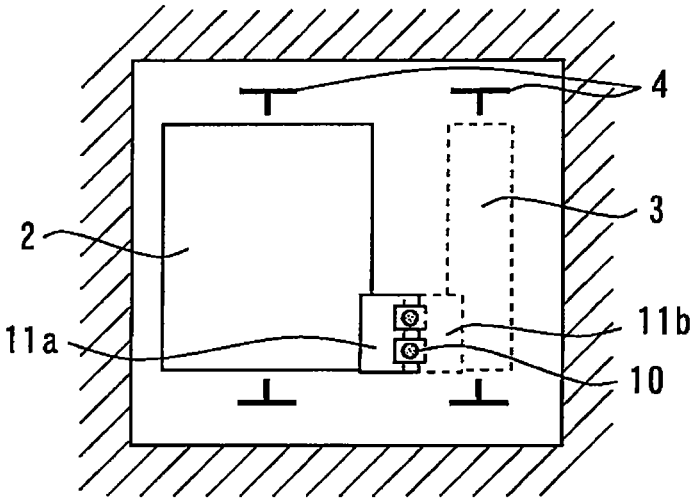
FIG. 2 is a plan view of a car power supply device of an elevator related to first embodiment of the present invention.
Figure 3:
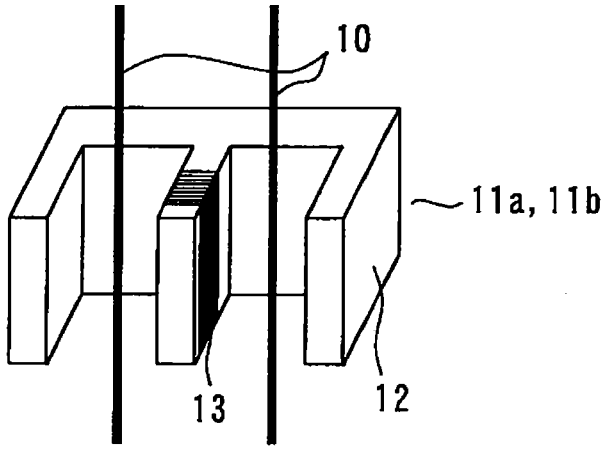
FIG. 3 is a perspective view showing a power supply line and a receiving end related to first embodiment of the present invention.
Figure 4:
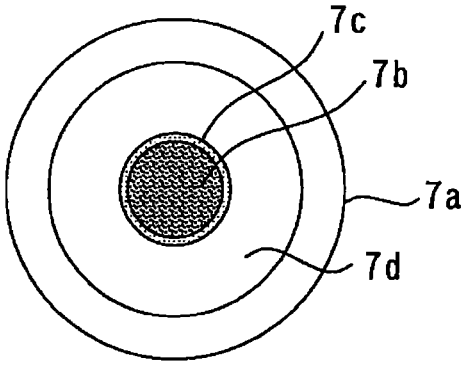
FIG. 4 is a sectional view of a compensating rope related to first embodiment of the present invention.
Figure 5:
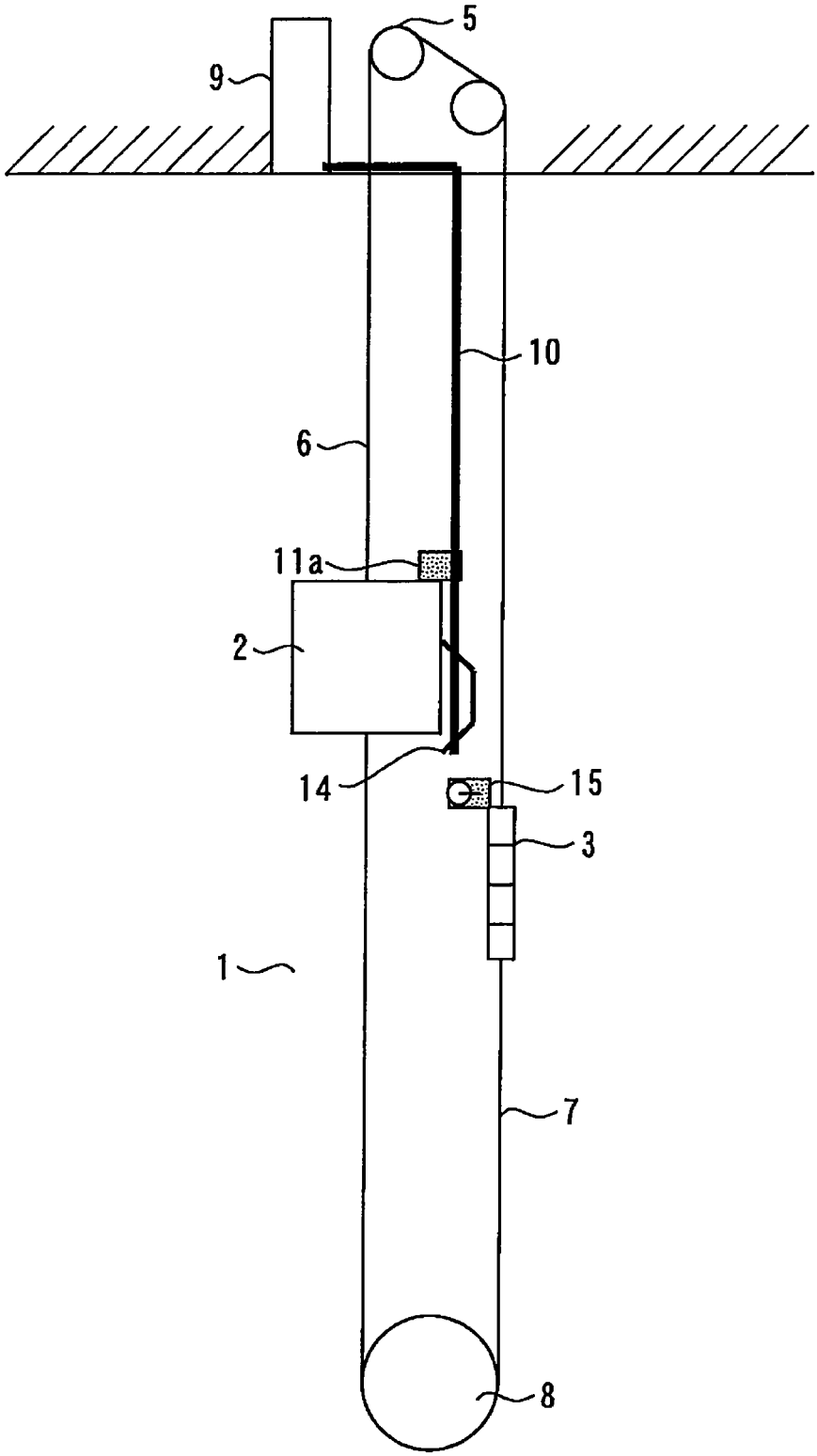
FIG. 5 is a side view showing the general configuration of a car power supply device of an elevator related to first embodiment of the present invention.
Figure 6:
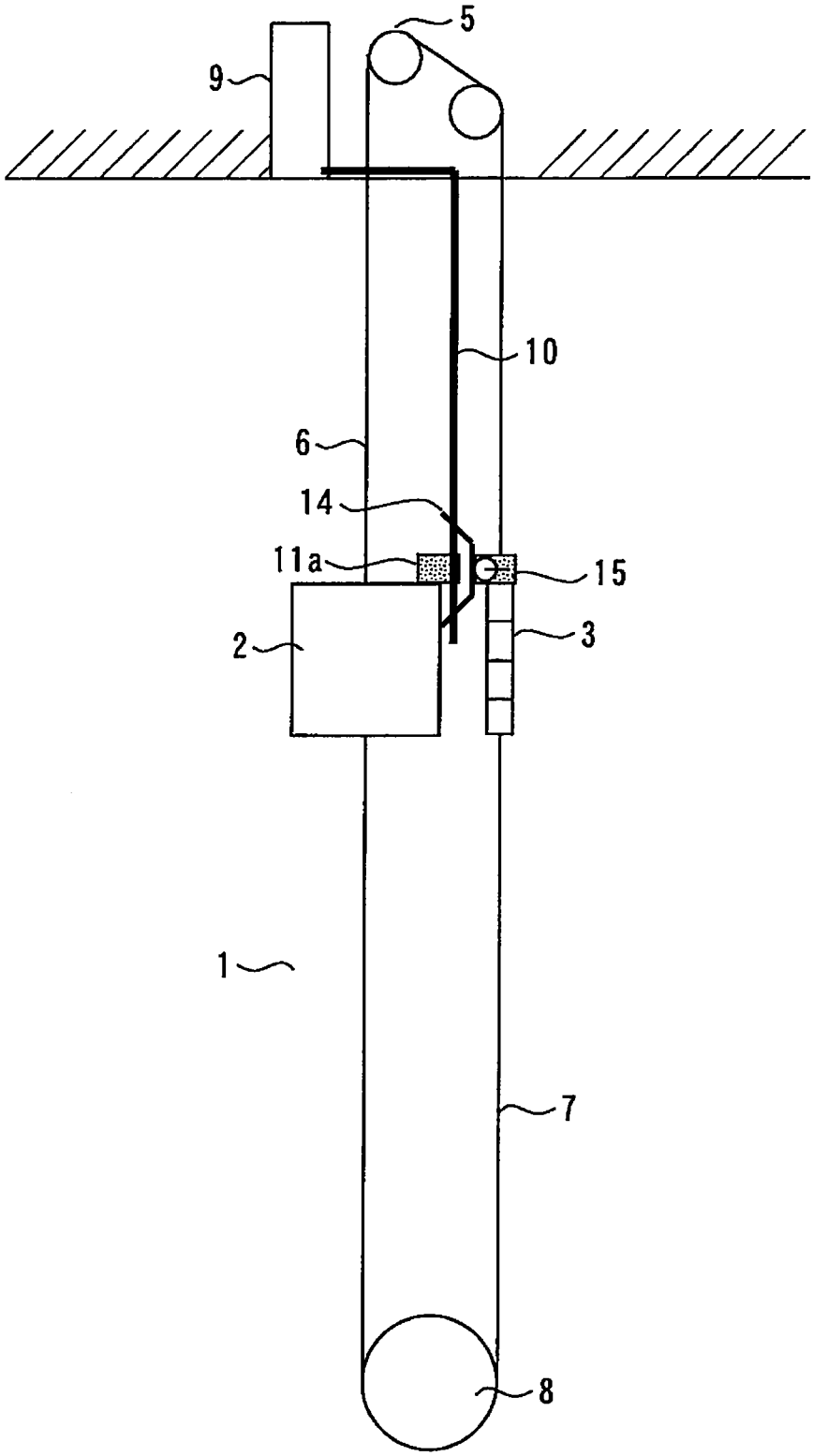
FIG. 6 is a view showing how a car and a counterweight pass by each other related to first embodiment of the present invention.
Figure 7:
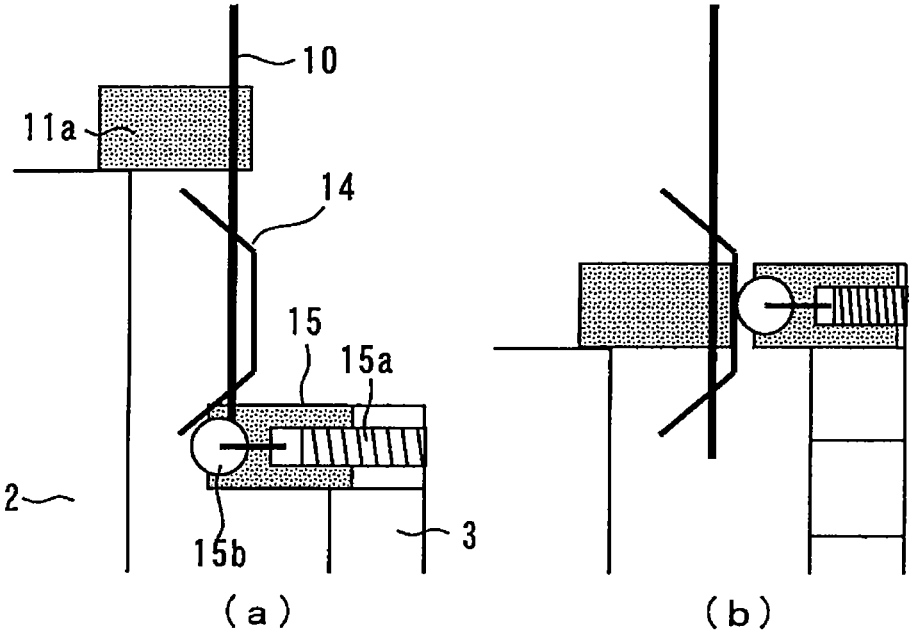
FIGS. 7(*a*) and 7(*b*) are enlarged diagrams to explain an essential part of FIG. 6 related to first embodiment of the present invention.
Figure 8:
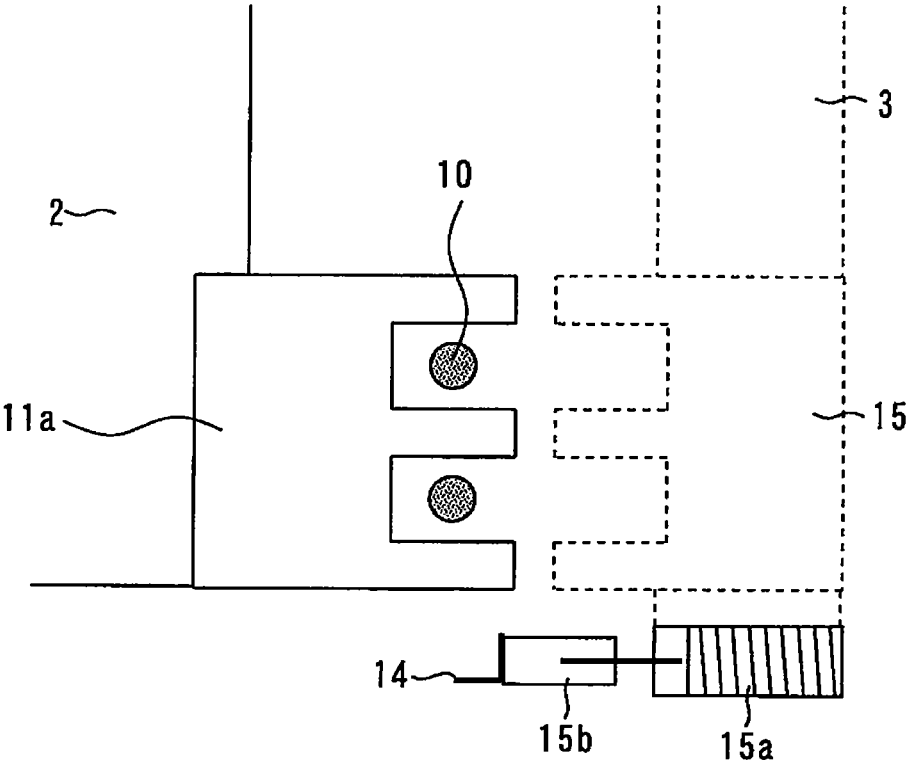
FIG. 8 is a plan view in the condition of FIG. 7(*b*) related to first embodiment of the present invention.

FIGS. 1 to 8 relate to Embodiment 1 of the present invention. FIG. 1 is a side view showing the general configuration of a car power supply device of an elevator, FIG. 2 is a plan view of a car power supply device of an elevator, FIG. 3 is a perspective view showing a power supply line and a receiving end, and FIG. 4 is a sectional view of a compensating rope. FIG. 5 is a side view showing the general configuration of a car power supply device of an elevator, FIG. 6 is a view showing how a car and a counterweight pass by each other, FIGS. 7(*a*) and 7(*b*) are enlarged diagrams to explain an essential part of FIG. 6, and FIG. 8 is a plan view in the condition of FIG. 7(*b*).

Incidentally, in the plan views of FIGS. 2 and 8, the parts on the counterweight side are indicated by a broken line to make a clear discrimination.

In the Figures, reference numeral 1 denotes the shaft of an elevator and in this shaft 1, a car 2 with passengers and the like thereon is arranged in such a manner as to be able to ascend and descend. Furthermore, in the shaft 1, a counterweight 3 which compensates for the load applied to this car 2 is also arranged in such a manner as to be able to ascend and descend.

The car 2 and the counterweight 3 each slidably engage against guide rails 4 each installed in pairs in a standing condition in the shaft 1, and each ascends and descends in the shaft by being guided by these guide rails 4.

A traction machine 5 for driving in the ascent and descent of the car 2 and the counterweight 3 is arranged in a machine room provided at the top of the shaft 1.

And one end of a main rope 6 is connected to an upper part of the car 2, and the middle of this main rope 6 is wound on a driving sheave of the traction machine 5 and the other end of the main rope 6 is connected to an upper part of the counterweight 3, whereby the car 2 and the counterweight 3 are hung in a well-bucket manner in the shaft 1.

In order to prevent the load of the main rope 6 from being applied mainly to the car 2 side or the counterweight 3 side in an unbalanced manner, one end of the compensating rope 7 is connected to a lower part of the car 2 and the other end of the compensating rope 7 is connected to a lower part of the counterweight 3. The middle of this compensating rope 7 is wound on a compensating sheave 8 which is provided in such a manner as to be movable vertically in the area near the bottom of the shaft 1.

And a control panel 9 governing the control of the whole operation of the elevator in question, including power supply to the car 2, is installed in the machine room at the top of the shaft 1.

A power supply line 10 for feeding power to the car 2 and the counterweight 3 is arranged from this control panel 9 along the path of the car 2 and the counterweight 3 in the shaft 1. As shown in FIG. 2, this power supply line 10 is arranged so as to be positioned between the hoistway of the car 2 and the hoistway of the counterweight 3.

A car-side receiving end 11*a* is attached to the upper part of the car 2 in such a manner as to be opposed to the power supply line 10 from one side of the power supply line 10, and this car-side receiving end 11*a* moves along the power supply line 10 due to the ascent and descent of the car 2.

A weight-side receiving end 11*b* is attached to the upper part of the counterweight 3 from the side opposite to the car-side receiving end 11*a* with respect to the power supply line 10 so as to be opposed to the power supply line 10, and this weight-side receiving end 11*b* moves along the power supply line 10 due to the ascent and descent of the counterweight 3.

The receiving equipment is configured in such a manner that the car-side receiving end 11*a* and the weight-side receiving end 11*b* receive the supply of power from the same power supply line 10 in a noncontact manner.

Specifically, as shown in FIG. 3, the car-side receiving end 11*a* and the weight-side receiving end 11*b* are mainly composed of an iron core 12 which is substantially E-shaped in a planar view and a coil 13 made up of an electrically-conductive wire wound on the middle convexity of this iron core 12.

And the power supply line 10 is composed of a pair of conductive wires, and the power supply wire 10 as well as the car-side receiving end 11*a* and the weight-side receiving end 11*b* are arranged so that each of these two power supply wires 10 is threaded through two concavities of the iron core 12 without coming into contact with the iron core 12.

In the power supply wire 10, car-side receiving end 11*a* and weight-side receiving end 11*b* which are configured like this, an alternating current is caused to flow from the control panel 9 to the power supply line 10, whereby the power supply line 10 and the receiving end engage electromagnetically with each other to form an electromagnetic circuit, and an electromotive force is generated in the coil 13 of the receiving end, with the result that power supply is performed in a noncontact manner from the power supply line 10 to the receiving end.

The power received by the weight-side receiving end 11*b* via the power supply line 10 is transmitted to the car 2 via the compensating rope 7 capable of power transmission and having a cross-sectional configuration as shown in FIG. 4, for example.

This compensating rope 7 capable of power transmission is made up of a plurality of strands 7*a*. A strand 7*a* has an electrically-conductive conductor 7*b* in the central part, the periphery of this conductor 7*b* is covered with an insulator 7*c* which does not conduct electricity, and furthermore a core wire 7*d* formed from a steel wire and the like is provided on the outer side of this insulator 7*c*.

And the compensating rope 7 is formed by bundling a plurality of these strands 7*a* as described above. The compensating rope 7 thus formed is capable of power transmission by the conductor 7*b* and constitutes the power transmission device which transmits power from the counterweight 3 side to the car 2 side.

As described above, the power received by the weight-side receiving end 11*b* is transmitted to the car 2 via the compensating rope 7 which is the power transmission device. In the case where the power transmitted from the counterweight 3 side to the car 2 side is large, a plurality of compensating ropes are configured to be capable of power transmission as described above, whereby it is possible to transmit power by parallel wires.

The car power supply device of an elevator configured as described above receives power from the same power supply line on both the car 2 side and the counterweight 3 side, and the power received on the counterweight 3 side can be transmitted to the car 2 side via the compensating rope 7.

Therefore, in the case where the car-side receiving end 11*a* engages electromagnetically with the power supply line 10, power supply to the car 2 is performed by this car-side receiving end 11*a*, whereas in the case where the weight-side receiving end 11*b* engages electromagnetically with the power supply line 10, the power received by the weight-side receiving end 11*b* is transmitted from the counterweight 3 side to the car 2 side via the compensating rope 7, whereby It is possible to feed power to the car 2.

That is, in the process of ascent and descent of the car 2, if at least either the car-side receiving end 11*a* or the weight-side receiving end 11*b* engages electromagnetically with the power supply line 10, power supply to the car 2 is possible.

Therefore, because the elevator in question is such that the car 2 and the counterweight 3 ascend and descend in a well-bucket manner (that is, when one is caused to ascend, the other descends accordingly), it is possible to feed power from the power supply line 10 to the car 2 along the whole path of the car 2, even when as shown in FIG. 5, the power supply line 10 has a length corresponding to substantially the upper half of the path of the car 2 and the counterweight 3, which is a length along which at least either of the car-side receiving end 11*a* or the weight-side receiving end 11*b* can engage electromagnetically with the power supply line 10 and it is possible to receive power supply from the power supply line 10 (the power supply line 10 and the receiving end overlap as viewed from the side).

Incidentally, the reason why the power supply line 10 is arranged rather nearer to the upper side is that this arrangement is convenient for the arrangement of the control panel 9 to be connected to this power supply line 10 at the top of the shaft 1. Therefore, in particular, in the case where the device which supplies power to the power supply line 10, such as the control panel 9 are arranged at the bottom (for example, a pit) of the shaft 1, it is possible to arrange the power supply line 10 in a place rather nearer to the lower side.

A cam rail for preventing received end interference 14 is provided in the vicinity of the middle part of the path where the car 2 and the counterweight 3 pass by each other, which is adjacent to the power supply line 10, and in a manner corresponding to this, either the car-side receiving end 11*a* or the weight-side receiving end 11*b* serves as a receiving end having an interference prevention mechanism 15. Here, a description will be given on the assumption that the weight-side receiving end 11*b* serves as the receiving end having an interference prevention mechanism 15.

This receiving end having an interference prevention mechanism 15 is attached to the counterweight 3 via a damper 15*a* composed of a coil spring provided beside the iron core 12 of the receiving end, and the iron core 12 of the receiving end is provided so as to be movable in the vertical direction to a surface formed by the two power supply lines 10.

Through the use of the elastic force thereof, the damper 15*a* urges the iron core 12 of the receiving end having an interference prevention mechanism 15 in the direction in which the iron core 12 is caused to become close to the power supply line 10.

And a roller 15*b* is attached to the end portion of the damper 15*a* on the power supply line 10 side, and a substantially trapezoidally-shaped cam rail for preventing received end interference 14 is arranged in a position which is opposed to the roller 15*b* of the receiving end having an interference prevention mechanism 15 in the vicinity of the middle part of the path where the car 2 and the counterweight 3 pass by each other, which is adjacent to the power supply line 10, so that the convexity thereof faces the counterweight 3 side.

In this manner, the cam rail for preventing received end interference 14 and the receiving end having an interference prevention mechanism 15 are each provided with interference prevention devices for preventing interference between the receiving ends from interfering with each other when the car 2 and the counterweight 3 pass by each other.

When the car 2 ascends and descends and passes the counterweight 3, the roller 15*b* of the receiving end having an interference prevention mechanism 15 abuts against the cam rail for preventing received end interference 14 and moves by rolling the convexity side of the cam rail for preventing received end interference 14 (FIG. 7*a*).

Then, the roller 15*b* is pushed by this cam rail for preventing received end interference 14 in the direction in which the roller 15*b* is spaced from the power supply line 10, that is, the receiving end having an interference prevention mechanism 15 resists the urging force of the damper 15*a*, and is pushed in the direction in which the receiving end having an interference prevention mechanism 15 is spaced from the power supply line 10, and moves to the position in which the receiving end having an interference prevention mechanism 15 does not come into contact with the car-side receiving end 11*a*, whereby the receiving end having an interference prevention mechanism 15 is prevented from interfering with the car-side receiving end 11*a* (FIGS. 7*b* and 8).

When passing by each other is completed, the roller 15*b* does not abut any more against the cam rail for preventing received end interference 14, and by the urging force of the damper 15*a* the receiving end having an interference prevention mechanism 15 returns in the direction in which the receiving end having an interference prevention mechanism 15 approaches the power supply line 10.

Therefore, in the case where the counterweight 3 is in the upper half of the path, the power supply line 10 is threaded through the concavity of the iron core 12, and the power supply line 10 and the receiving end having an interference prevention mechanism 15 engage electromagnetically with each other, making it possible to feed power.

In the car power supply device of an elevator configured like this, for example, in the case where the car 2 descends from the top floor to the bottom floor, first, the car 2 is present in the upper half of the path and the counterweight 3 is present in the lower half of the path and, therefore, the car-side receiving end 11*a* engages electromagnetically with the power supply line 10 and power supply to the car 2 is performed via this car-side receiving end 11*a*.

And the counterweight 3 ascends in a well-bucket manner as the car 2 descends gradually and when the car 2 approaches the position where the car 2 passes the counterweight 3 in the middle part of the path, the roller 15*b* of the receiving end having an interference prevention mechanism 15, which is the car-side receiving end 11*a*, abuts against the cam rail for preventing received end interference 14.

Then, the roller 15*b* moves by rolling on the convexity side of the cam rail for preventing received end interference 14, whereby the receiving end having an interference prevention mechanism 15 moves in the direction in which the receiving end having an interference prevention mechanism 15 becomes spaced from the power supply line 10 and passes the car-side receiving end 11*a* without interference.

Furthermore, the car 2 continues descending and when the passing-by of the car-side receiving end 11*a* and the receiving end having an interference prevention mechanism 15, which is the weight-side receiving end 11*b*, is completed, the roller 15*b* does not abut any more against the cam rail for preventing received end interference 14, and by the urging force of the damper 15*a* the receiving end having an interference prevention mechanism 15 returns in the direction in which the receiving end having an interference prevention mechanism 15 approaches the power supply line 10.

At this time, the car 2 is present in the lower half of the path and the counterweight 3 is present in the upper half of the path and, therefore, the cam rail for preventing received end interference 14 and the roller 15*b* do not abut any more against each other, the receiving end having an interference prevention mechanism 15 which has returned to the normal position engages electromagnetically with the power supply line 10 and receives the power supply.

And thereafter until the car 2 arrives at the bottom floor, the power received by the receiving end having an interference prevention mechanism 15, which is the weight-side receiving end 11*b*, is transmitted to the car 2 side via the compensating rope 7 capable of power transmission, and power supply to the car 2 is performed.

And contrastingly, in the case where the car 2 ascends from the bottom floor to the top floor, first, the car 2 is present in the lower half of the path and the counterweight 3 is present in the upper half of the path and, therefore, the receiving end having an interference prevention mechanism 15, which is the weight-side receiving end 11*b*, engages electromagnetically with the power supply line 10 and receives the power supply.

And the power received by this receiving end having an interference prevention mechanism 15 is transmitted to the car 2 side via the compensating rope 7 capable of power transmission, and power supply to the car 2 is performed.

The counterweight 3 descends in a well-bucket manner as the car 2 ascends gradually and when the car 2 approaches the position where the car 2 passes by the counterweight 3 in the middle part of the path, the roller 15*b* of the receiving end having an interference prevention mechanism 15, which is the car-side receiving end 11*a*, abuts against the cam rail for preventing received end interference 14.

Then, the roller 15*b* moves by rolling on the convexity side of the cam rail for preventing received end interference 14, whereby the receiving end having an interference prevention mechanism 15 moves in the direction in which the receiving end having an interference prevention mechanism 15 becomes spaced from the power supply line 10 and passes by the car-side receiving end 11*a* without interference.

And on this occasion the electromagnetic engagement between the power supply line 10 and the receiving end having an interference prevention mechanism 15 is released by the departure of the receiving end having an interference prevention mechanism 15 from the power supply line 10. The length of the power supply line 10 is adjusted so that in the position where the roller 15*b* starts the contact with the cam rail for preventing received end interference 14, the power supply line 10 is arranged in the concavity of the iron core 12 of the car-side receiving end 11*a* and the car-side receiving end 11*a* engages electromagnetically with the power supply line 10.

Therefore, when the roller 15*b* of the receiving end having an interference prevention mechanism 15, which has been attached to the descending counterweight 3, starts the contact with the cam rail for preventing received end interference 14, at this time the car-side receiving end 11*a* engages electromagnetically with the power supply line 10 and power supply to the car 2 is performed via this car-side receiving end 11*a*.

And thereafter until the car 2 arrives at the top floor, power supply to the car 2 is performed via the car-side receiving end 11*a*.

Incidentally, although in this case, as the power transmission device which transmits the power received from the power supply line by use of the receiving end of the counterweight to the car, the compensating rope capable of power transmission, which incorporates a conductor in the interior, is used, it is also possible to use other means and methods, such as incorporating a conductor in the main rope from which the car and the counterweight are hung.

Although the power receiving device is of such a configuration that the power supply is received in a noncontact manner, it is also possible to configure the power receiving device as a contact type power supply/receiving device in which a power supply rail and a brush are used.

The car power supply device of an elevator configured as described above is a car power supply device of an elevator which lifts and lowers a car and a counterweight in a well-bucket manner which are arranged in such a manner as to be able to ascend and descent in a shaft of the elevator including: a power supply line which is arranged in the shaft along the path of the car and the counterweight, and power receiving devices which are provided each in the car and the counterweight and receive power supply from the power supply line. In this car power supply device of an elevator, the power receiving device of the car and the power receiving device of the counterweight receive power supply from the same power supply line.

For this reason, power supply to the car is performed by use of the power supply line provided in the shaft without using a pathing cable, the installability and planar layout capability of the power supply line are good, and the weight balance between the car and the counterweight is also good.

In addition, a power transmission device which transmits the power received by the power receiving device of the counterweight from the power supply line to the car is further provided, whereby it is possible to use the power received on the weight side in power supply to the car, making it possible to easily double the power supply to the car.

And this power transmission device uses the compensating rope capable of power transmission, which is obtained by incorporating a conductor in the interior of a compensating rope which is originally provided in an elevator, whereby it is possible to transmit power from the weight side to the car side without increasing the equipment weight of the whole elevator.

Furthermore, the power supply line is arranged along substantially the upper half or substantially the lower half of the path of the car and the counterweight so that at least either the power receiving device of the car or the power receiving device of the counterweight can receive the power supply from the power supply line, whereby it is only necessary that the power supply line be installed along about the half of the path. Therefore, the layout capability of the shaft is excellent and the labor saving in installation and maintenance work is made possible. At the same time, the length of the power supply line which transmits power becomes short and it is possible to reduce power losses due to line resistance and impedance.

Moreover, the car power supply device of an elevator is further provided with an interference prevention device which prevents the interference between the power receiving device of the car and the power receiving device of the counterweight when the car and the counterweight pass each other. Therefore, when the car-side power receiving device and the weight-side power receiving device receive power from the same power supply line, it is possible to ensure power feeding by preventing the interference, collision, breakage and the like of these power receiving devices.

Also, the power receiving device receives power supply from the power supply line in a noncontact manner, whereby friction does not occur between pieces of equipment. Therefore, maintenance becomes unnecessary and it is possible to make the maintenance work efficient and to reduce costs. At the same time, because contact resistance due to friction does not occur, it is possible to hold energy losses in the whole elevator at low levels.

INDUSTRIAL APPLICABILITY

In an elevator which lifts and lowers a car and a counterweight in a well-bucket manner which are arranged in such a manner as to be able to ascend and descend in a shaft of the elevator, the present invention can be used in the car power supply device of the elevator which supplies power in order to drive various kinds of equipment provided in the car.

DESCRIPTION OF SYMBOLS

1 shaft
2 car
3 counterweight
4 guide rails
5 traction machine
6 main rope
7 compensating rope
7*a* strands
7*b* conductor
7*c* insulator
7*d* core wire
8 compensating sheave
9 control panel
10 power supply line
11*a* car-side receiving end
11*b* weight-side receiving end
12 iron core
13 coil
14 cam rail for preventing received end interference
15 receiving end having an interference prevention mechanism
15*a* damper
15*b* roller

The invention claimed is:

1. A car power supply device of an elevator which lifts and lowers a car and a counterweight in a well-bucket manner which are arranged in such a manner as to be able to ascend and descend in a shaft of the elevator, comprising:

an electrical power supply line which is arranged in the shaft along the path of the car and the counterweight;

power receiving devices which are provided each in the car and the counterweight and receive electrical power supply from the electrical power supply line; and a power transmission device which transmits the electrical power received from the electrical power supply line by the power-receiving device of the counterweight to the car, wherein the power receiving device of the car and the power receiving device of the counterweight both receive electrical power supply from the same electrical power supply line, and wherein the electrical power supply line is entirely arranged vertically and is vertically provided only along substantially the upper half or substantially the lower half of the path of the car and the counterweight at a location to make contact with the power receiving devices which are provided each in the car and the counterweight, so that either the power receiving device of the car or the power receiving device of the counterweight can receive electrical power supply from the electrical power supply line.

2. The car power supply device of an elevator according to claim 1, wherein the power transmission device has a compensating rope capable of power transmission which is provided by coupling the car and the counterweight together in order to prevent a load imbalance of a main rope hanging the car and the counterweight and incorporates an electrical conductor in the interior thereof.

3. The car power supply device of an elevator according to claim 2, further comprising:

an interference prevention device which prevents interference between the power receiving device of the car and the power receiving device of the counterweight when the car and the counterweight pass each other.

4. The car power supply device of an elevator according to claim 3, wherein the power receiving devices receive electrical power supply from the electrical power supply line in a noncontact manner.

5. The car power supply device of an elevator according to claim 2, wherein the power receiving devices receive electrical power supply from the electrical power supply line in a noncontact manner.

6. The car power supply device of an elevator according to claim 1, further comprising:

an interference prevention device which prevents interference between the power receiving device of the car and the power receiving device of the counterweight when the car and the counterweight pass each other.

7. The car power supply device of an elevator according to claim 6, wherein the power receiving devices receive electrical power supply from the electrical power supply line in a noncontact manner.

8. The car power supply device of an elevator according to claim 1, wherein the power receiving devices receive electrical power supply from the electrical power supply line in a noncontact manner.

* * * * *